United States Patent [19]

Tellié

[11] B 4,012,844

[45] Mar. 22, 1977

[54] SIGHTING DEVICES FOR FIREARMS

[75] Inventor: Paul E. Tellié, St.-Etienne, France

[73] Assignee: Etat Francais, Paris, France

[22] Filed: May 20, 1974

[21] Appl. No.: 471,681

[44] Published under the second Trial Voluntary Protest Program on April 13, 1976 as document No. B 471,681.

[30] Foreign Application Priority Data

June 1, 1973 France ..... 73.19955

[52] U.S. Cl. ..... 33/252

[51] Int. Cl.[2] ..... F41G 1/02

[58] Field of Search ..... 33/233, 252, 256, 257, 33/258

[56] References Cited

UNITED STATES PATENTS

| | | | |
|---|---|---|---|
| 800,195 | 9/1905 | Windridge | 33/252 |
| 1,523,319 | 1/1925 | Vosmek | 33/258 |
| 1,908,019 | 5/1933 | Howard | 33/252 |
| 2,132,490 | 10/1938 | Mossberg | 33/257 |

*Primary Examiner*—Houston S. Bell, Jr.
*Assistant Examiner*—Richard R. Stearns
*Attorney, Agent, or Firm*—Stevens, Davis, Miller & Mosher

[57] ABSTRACT

Adjusting mechanism for the front sight and the rear sight of a firearm in which the sighting line is located a relatively large distance above the firearm. The adjusting mechanism includes an elastically deformable member in the form of a rod for the rear sight and in the form of a flat blade for the front sight. The rod has a first end which is fastened to the rear sight support and a second end rigidly connected with the rear sight. The flat blade has a first end fastened to the front sight support and a second end rigidly connected with the top of the front sight. A control, in the form of a rotatable screw receivable in an internally threaded member, is provided for each sight for varying the distance between an area of each member and its respective support. Adjustment of the rear sight is, advantageously, only in a direction perpendicular to the longitudinal axis of the barrel of the firearm. Adjustment of the front sight is in a substantially horizontal direction transverse to the longitudinal axis of the barrel of the firearm.

11 Claims, 6 Drawing Figures

SIGHTING DEVICES FOR FIREARMS

The present invention relates to improvements in sighting means or devices for a firearm, such sighting devices comprising a rear sight and a front sight. More particularly, the present invention concerns sighting devices of this type in which the rear sight and the front sight are arranged on a support, the position of which is fixed with respect to the firearm and which has means for the adjustment of the rear sight and/or the front sight.

The said adjusting means make it possible to modify the position of the sighting line with respect to the longitudinal axis of the barrel of the firearm. This adjustment of the position of the line of sight is necessary, for instance, in order to adjust the sight to the distance of the target, or when the barrel has been deformed, or else upon the first use of a new firearm.

The adjusting means for sighting devices known up to the present time can for all practical purposes not be used for sighting devices of the type in which the line of sight is spaced from the upper portion of the firearm.

The object of the invention, therefore, is to provide means for regulating the rear sight and/or the front sight of a firearm in which the sighting line is located at a relatively large distance above the firearm.

Another object is to provide an adjusting means for a firearm sighting device which is easy to produce and simple to use.

Finally, another object of the invention is to provide sighting devices in which the adjusting means make it possible to effect an adjustment which cannot be accidentally interfered with.

A sighting device of the type in question, that is to say, one comprising a rear sight and a front sight which are arranged on a support having a fixed position with respect to the firearm and have adjusting means for the rear sight or the front sight is characterized in accordance with the invention by the fact that the adjusting means comprises an element forming an elastically deformable metal rod or blade having a first end fastened to the support of the rear sight or of the front sight and a second end which is rigidly connected with the rear sight or with the top of the front sight and control means for varying the distance between a region of the said element forming an elastically deformable metal rod or blade and the support in such a manner that the variation of this distance causes a displacement of the rear sight or of the top of the front sight.

The rear-sight support advantageously has a front wall provided with guide means adapted to cooperate with a guide member which is rigidly connected with the rear sight, these guide means and member being arranged in such a manner that the sliding of the rear sight can take place only in a direction substantially perpendicular to the longitudinal axis of the barrel of the firearm; in this case the said element which forms an elastically deformable metal rod or blade comprises a first branch and a second branch which form an obtuse angle with each other, when the said adjusting means is in operating condition, the end of the first branch constitutes the said first end and being fastened to the front wall of the rear sight support, and the end of the second branch constitutes the said second end, and said control means being adapted to vary the said obtuse angle.

The element forming an elastically deformable metal rod or blade also advantageously forms part of the means for adjusting the front sight and normally has the shape of a flat blade. The top of the front sight is an extension, on the same side as the second end, of the flat blade. The said blade and the top of the front sight preferably form a single piece.

In the preferred embodiment of the invention, the control means comprises a screw which has a head and is adapted to cooperate with a second wall of the rear sight or front sight support in such a manner that the rotation of the said screw causes a variation in the distance between the said region of the said element and the second wall.

The arrangements, characteristics, and advantages of the invention will become evident from a reading of the following description of the preferred embodiment of the invention, this description being given with reference to the accompanying drawings in which.

DESCRIPTION OF THE PREFERRED EMBODIMENT

Figure 1:
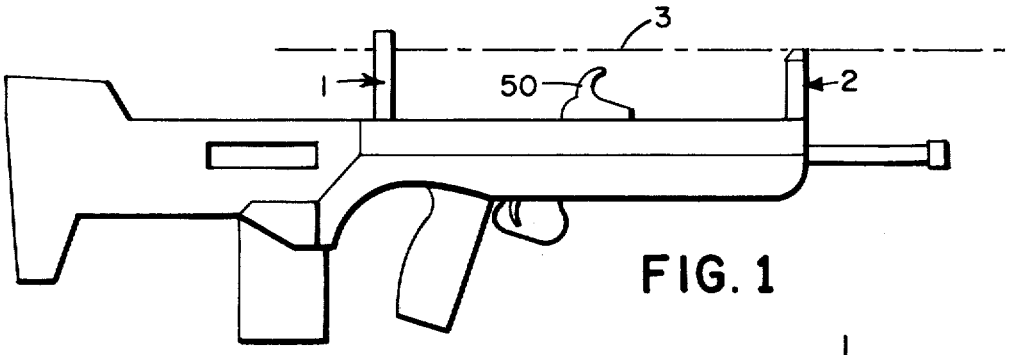
FIG. 1 illustrates a firearm having sighting means.

FIG. 1 shows a firearm provided with sighting means. These sighting means, in a manner known per se, comprise a rear sight 1 and a front sight 2. Although the rear sight shown in FIG. 2 has a peephole the invention applies alsso to rear sights with a sighting notch.

The adjusting means in accordance with the invention, which will be described below with reference to FIGS. 2 to 6, make it possible to modify the position of the line of sight 3 with respect to the firearm.

The adjusting means which are associated with the rear sight make it possible to displace the opening $1_a$ of the peephole in a direction perpendicular to the longitudinal axis of the barrel of the firearm by moving said opening towards or away from the axis. The adjusting means associated with the front sight make it possible to displace said sight in a transverse direction with respect to the axis of the barrel; in this case, however, the distance between the top of the front sight and the said longitudinal axis of the barrel remains substantially constant.

Figure 2:
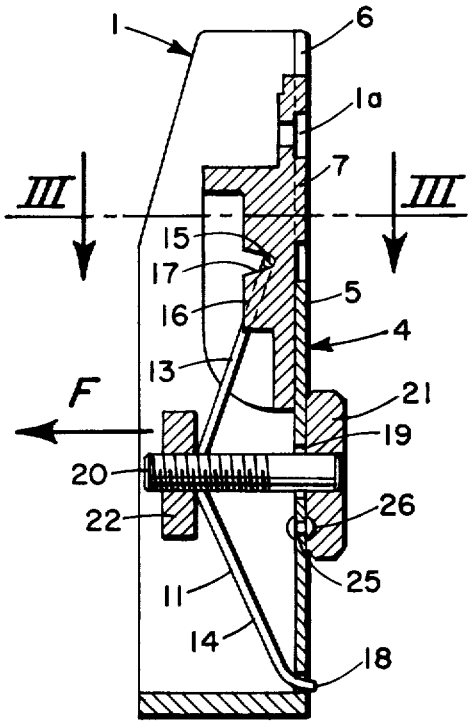
FIG. 2 shows in cross section and on a larger scale rear sight adjusting means in accordance with the invention.
Figure 3:
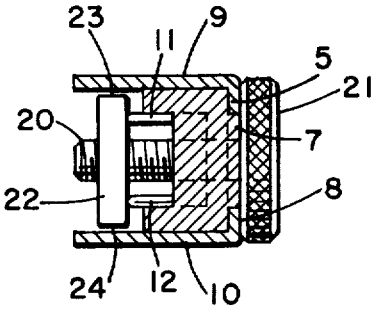
FIG. 3 is a cross section along the line III—III of FIG. 2.

FIGS. 2 and 3 illustrate means for regulating the position of the peephole. In the example shown in these figures the rear sight 1 is rigidly connected with a support 4 having a substantially flat front wall 5 perpendicular to the line of sight 3. The upper part of said wall 5 has a slit 6 whose width is a large fraction of the width of the wall 5. This slit 6 constitutes a guide for a rib 7 provided in the upper portion of the rear sight 1. This rib 7 has, of course, a width which is slightly less than the width of the slit 6. For purposes of guiding also, the front wall 8 of the rear sight 1 rests against the inner surface of the wall 5. Furthermore, the support 4 has two side walls 9 and 10 which are perpendicular to the wall 5 and the distance between the side faces of the rear sight is very slightly less than the distance between the inner faces of the said side walls 9 and 10.

In the example shown in FIGS. 2 and 3 the elastically deformable element is formed of a double metal rod having two portions 11 and 12. These two portions 11 and 12 are produced from the same metal rod which has been curved back at its center so that the said portions are parallel to each other. Furthermore, each of these rods is curved back at the same height so as to form two branches 13 and 14. The angle thus produced between these two branches is obtuse, at least when the said double rod is in operating position, as shown in FIG. 2. The top 15 of the double rod surrounds a boss 16 provided in the rear portion of the rear sight 1. Furthermore, above the boss 16 there is provided a slit 17 one of whose edges is formed by the upper portion of the boss 16 and whose width, at least at the bottom of said slit, is very slightly greater than the diameter of the said top 15 of the double rod. The upper portion of the double rod is therefore firmly connected with the rear sight and can move the latter upwards (the distance between the axis of the barrel of the firearm and the peephole increasing) or downward (the distance between the peephole and the axis of the barrel decreasing).

The ends of the double rod, that is to say the lower ends 18 of the rods 11 and 12, are curved back so that they can be introduced into an opening provided at the lower portion of the side wall 5 of the support 4. The said ends 18 therefore have a fixed position with respect to the support 4 of the rear sight.

Substantially at the level of the apex of the angle formed by the branches 13 and 14 of the rods 11 and 12 the wall 5 is provided with a circular opening 19. This opening 19 makes it possible to introduce a screw 20 between the rods 11 and 12. The knurled head 21 of the screw 20 applies itself against the outer face of the wall 5. It is therefore necessary for the diameter of the opening 19 to be larger than the diameter of the screw 20 but smaller than the diameter of the head 21. The screw 20 cooperates with a nut 22 which can move in a direction perpendicular to the wall 5 (that is to say, parallel to the axis of the barrel). However, this nut 22 cannot turn around the axis of its threading, that is to say, around the axis of the screw. For this purpose, in the example shown, the nut 22 has two flats or flat faces 23 and 24 which are parallel; the distance between these flats 23 and 24 is slightly less than the distance between the inner faces of the side walls 9 and 10 of the support 4. This nut 22 is arranged behind the apex of the obtuse angle formed by the branches 13 and 14. In other words, the wall 5 and the double rod are between the screw head 21 and the nut 22.

On the front face of the wall 5, finally, there is arranged at least one protrusion 25 which, in the example shown, is riveted to said wall 5. The protrusion 25 is arranged in the vicinity of the opening 19 and is intended to cooperate with a corresponding recess 26 provided in the inner face of the head 21 of the screw 20. In the example shown, the said head 21 has a group of such recesses 26 which are distributed uniformly over the inner surface of the head 21 along a circular ring, the axis of which is identical with that of the screw 20.

The operation of the rear sight adjusting means shown in FIGS. 1 and 2 will now be described.

It will be noted first of all that, due to the elasticity of the double rod which tends to push the nut 22 back towards the rear, that is to say, in the direction indicated by the arrow F in FIG. 2, the inner face of the head 21 of the screw 20 is applied at all times against the outer face of the wall 5.

When it is desired to displace the opening $1_a$ of the peephole 1 vertically, that is to say, move said opening towards or away from the axis of the barrel, it is merely necessary to turn the knurled head 21 of the screw 20 in one direction or the other. As a matter of fact, the rotation of the screw 20 causes the displacement of the nut 22 (which cannot turn) along the axis of the screw. As the apex of the obtuse angle formed by the branches 13 and 14 is constantly applied against the nut 22 by reason of the direction of the force represented by the arrow F and since the lower end 18 of the double rod is fixed in place, the displacement of the nut 22 results in the displacement of the upper end 15 of the double rod and therefore the vertical displacement of the peephole 1 which is guided in the slit 6 of the wall 5.

Moreover, when the protrusion 25 is in a recess 26 the knurled head 21 has a definitely determined angular position and the opening $1_a$ of the peephole also has a definitely determined vertical position. This cooperation of the protrusions 25 and the recesses 26 prevents any accidental misadjustment of the rear sight. Another advantage of the assembly consisting of the recesses 26 and the protrusion 25 is that a precise adjustment of the position of the eyepiece can be effected.

It will finally be noted that the stiffness of the spring formed by the double rod can be selected in such a manner that it is not possible for all practical purposes to free the knurled head 21 from the protrustions 25 by a simple twisting action exerted by two fingers of a hand. In this case in order to modify the adjustment of the rear sight it is then necessary, using a finger of the other hand, to exert a force, in a direction opposite to that of the arrow F, on the end of the screw 20 in order to be able to turn the head 21.

Figure 5:
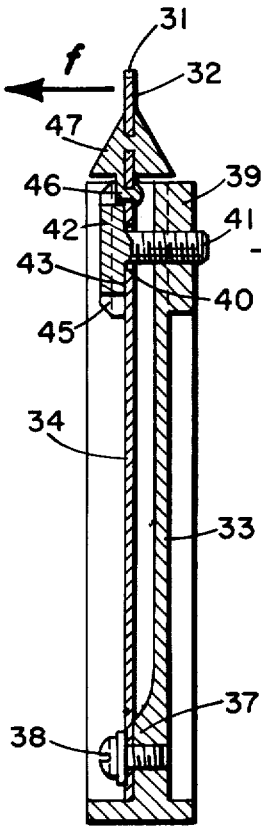
FIG. 5 is a cross section along the line V—V of FIG. 4
Figure 4:
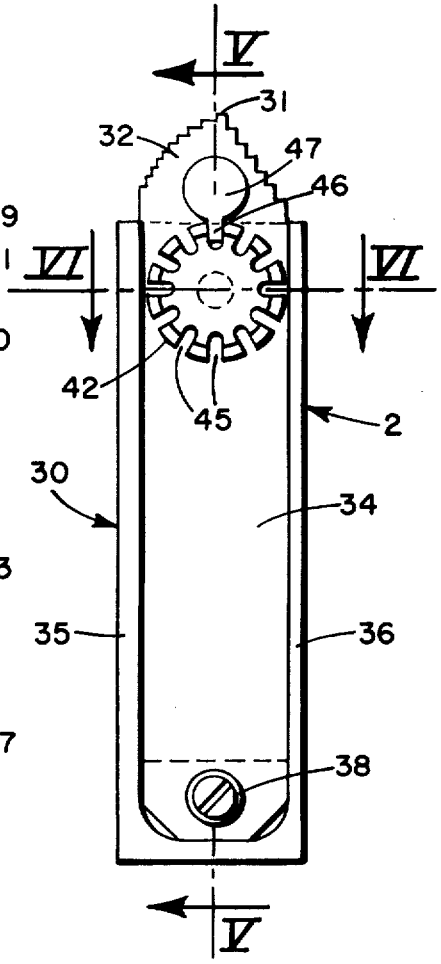
FIG. 4 shows a front sight provided with adjusting means in accordance with the invention.
Figure 6:
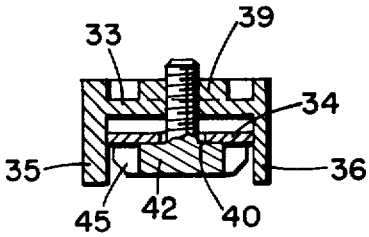
FIG. 6 is a cross section along the line VI—VI of FIG. 4.

A front sight arranged in a support 30 and provided with adjusting means in accordance with the invention will now be described with reference to FIGS. 4 to 6.

In this example, the front sight is shown thin. More precisely, the top 31 of this front sight constitutes the end of a flat plate 32 of relatively slight width; furthermore, the plane of this plate 32 contains the straight line formed by the sighting line.

The support 30 has substantially the shape of a channel section which extends in a direction perpendicular to the longitudinal axis of the barrel. The central wall 33 or web of this section has substantially the shape of a flat wall parallel to the said longitudinal axis of the barrel.

The elastically deformable element, in this embodiment of the invention, is formed of a substantially flat metal blade 34 arranged parallel to the wall 33 between the side branches 35 and 36 of the support 30. Furthermore, the width of this blade is very slightly less than the distance between the inner faces of the walls 35 and 36.

The inner face, at the U-section, of the wall 33 is substantially flat over the greater portion of its length; however, the lower portion of this inner face of the wall 33 protrudes in the inside of the shaped section and forms a boss 37 whose outer surfaces flatten parallel to the said wall 33. The lower end of the blade 34 is applied against this face of the boss 37; furthermore, this lower end of the blade 34 is fastened to the said lower portion of the wall 33 by a screw 38 which cooperates with an internal thread provided in the boss 37 and by means of a corresponding opening provided at the lower end of the blade 34.

The upper portion of the wall 33 also has a boss 39 but this boss 39 protrudes to the outside of the U-shaped section formed by the support 30.

In the example shown the front sight forms a single piece with the blade 34. In other words the upper edge of the blade 34 constitutes the top 31 of the front sight. At the level of the upper portion of the support 30 and of the boss 39, the blade 34 is provided with an opening 40 opposite which the wall 33 and the boss 39 have an internal thread the axis of which is perpendicular to the wall 33.

A screw 41 passes through the opening 40 and is screwed within the internal thread of the wall 33 and the boss 39. This screw has a head 42 whose inner face 43 is applied against the blade 34 in such a manner that said blade 34 is arranged between the head 42 and the wall 33. At rest, that is to say when the blade 34 is not mounted in the support 30 or when the screw 41 is not installed, the said blade has, at the level of the opening 40, a slight curvature (not shown) of such direction that when the blade is installed as shown in FIG. 5 it has an elasticity which tends to hold it against the head 42.

It is thus seen that by turning the head 42 of the screw 41 the upper end of the blade 34 is moved towards or away from the upper portion of the wall 33. In this way the top 31 of the front sight can move in the direction indicated by the arrow *f* or in the opposite direction. This displacement is in substantially horizontal direction.

The periphery of the head 42 has a group of notches 45 into each of which there can be introduced a protrusion 46 protruding from the face of the blade 34 which does not face the wall 33. The notches 45, in the example shown, are distributed uniformly on the periphery of the head 42. Furthermore, the protrusion 46 is made integral with a member 47 which forms a button. The button 47 extends on both sides of the flat faces of the blade 34 below the top 31 of the front sight and above the protrusion 46. This button 47, seen in cross section along a plane perpendicular to the blade 34, has the shape of an isosceles triangle, the apex of which is located on said blade below the top 31 of the front sight.

The assembly formed by the button 47 and the protrusion 46 can be produced by molding onto the upper portion of the blade 34. For this purpose two openings are provided in this upper portion of the blade 34.

The protrustion 46 and the notches 45 make it possible to impart definite positions to the screw head 42 and therefore to the top 31 of the front guide. Furthermore, this protrusion and these notches prevent the position of the top of the front sight from accidentally getting out of the adjusted position.

When it is desired to effect an adjustment of the position of the front sight, the protrusion 46 is released from the notch 45 in which it is engaged by pushing the upper portion of the blade 34 back in the direction opposite that indicated by the arrow *f*. It should be noted that this operation is facilitated by the button 47.

It will finally be noted that the shape of the button 47 improves the visibility of the top 31 of the front sight.

The protrusion 46 could, of course, be formed in any manner. This protrustion could, for instance, be formed by a bulging of the blade 34.

The means for adjusting the sighting device of a firearm which have just been described in connection with FIGS. 2 to 6 can, of course, lend themselves to numerous variants without thereby going beyond the scope of the invention. By way of example, it will be mentioned that the control means which permit varying the distance between a region of the elastically deformable element and a transverse wall of the rear sight or front sight support may comprise, instead of a screw, a cam which is arranged between the elastically deformable element and the transverse wall of the support. In another variant (not shown) which concerns the embodiment of the invention shown in FIGS. 2 and 3, the rear sight support has an additional wall parallel to the wall 5 and the head 21 is applied against the outer face of said additional transverse wall; in this case, the nut 22 must be located on the inside of the obtuse angle formed by the branches 13 and 14.

The adjusting means for the sighting device of a firearm which have been described with reference to FIGS. 2 to 6 have numerous advantages. By way of example, it may be pointed out that these adjusting means are easy to manufacture and particularly strong.

These adjusting means can be used for any type of firearm. However, their installation on a firearm whose line of sight is relatively high, that is to say, far away from the axis of the barrel, is particularly easy. This arrangement has been shown in FIG. 1 in which the line of sight 3 is high due to the presence of the cooking lever on the upper portion of this firearm.

As goes without saying and is furthermore evident from the foregoing, the invention is in no way limited to those of its methods of application or embodiments which have been more particularly described; rather it covers all possible variants.

What is claimed is:

1. A firearm comprising a rear sight and a front sight, each of said rear sight and said front sight being mounted on an associated support having a fixed position with respect to the firearm, means for adjusting each of said sights, said adjusting means for one of said sights comprising a flexible, substantially vertically extending metal flat blade having a first end fastened to said support of said one sight and a second end firmly connected to said one sight, said one sight being an extension of said second end of said blade, and control means for varying the distance between an area of said blade and said support of said one sight so that the varying of this distance causes a displacement of the one sight.

2. A firearm as claimed in claim 1 wherein the distance between the first end of said blade and the longitudinal axis of the barrel of the firearm is less than the distance between the second end of said blade and the longitudinal axis of the barrel of the firearm.

3. A firearm as in claim 2, wherein: said one sight is the front sight.

4. A firearm as in claim 3 wherein:

said flat blade and the front sight form a single piece.

5. A firearm as in claim 1 wherein:

said support of said one sight comprises a wall, said control means comprises a screw having a head, said screw being cooperable with said wall of said support of said one sight so that rotation of said screw results in variation in the distance between said area of said blade and said wall.

6. A firearm as claimed in claim 5 further comprising locking means for resisting rotation of the head of said screw.

7. A firearm as in claim 6, wherein:

said one sight is the front sight.

8. A firearm as claimed in claim 7 wherein:

said wall has an internal thread defined therein cooperable with the thread of said screw, said flat blade having an opening greater than the diameter of the shank of the screw but less than that of the head of the screw so that said blade can be positioned between the head of said screw and said front sight support wall, and said first end of said blade being fastened to said front sight support wall substantially parallel to said wall.

9. A firearm as claimed in claim 8 wherein:

said locking means comprises a protrusion extending outwardly from the plane of said blade adjacent the front sight, and at least one recess defined in the head of said screw, said recess extending radially into the head of said screw, and said protrusion being receivable in said recess.

10. A firearm as claimed in claim 9 wherein:

said at least one recess defined in the head of said screw comprises a series of notches arranged uniformly on the periphery of the head of said screw.

11. A firearm as claimed in claim 9 further comprising:

a button arranged below the second end of said blade, said button surrounding the faces of said blade adjacent said second end, the outer walls of said button which are on opposite sides of said blade converging towards said front sight, and said button being made of a single piece with said protrusion.

* * * * *